US007753727B1

(12) United States Patent
Islam et al.

(10) Patent No.: US 7,753,727 B1
(45) Date of Patent: Jul. 13, 2010

(54) THREADED CRIMP COAXIAL CONNECTOR

(75) Inventors: Nahid Islam, Westmont, IL (US); Jeffrey Paynter, Momence, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/471,205

(22) Filed: May 22, 2009

(51) Int. Cl.
*H01R 9/05* (2006.01)

(52) U.S. Cl. ..... 439/583

(58) Field of Classification Search ..... 439/583, 439/578

See application file for complete search history.

(56) References Cited

U.S. PATENT DOCUMENTS

| | | | | | |
|---|---|---|---|---|---|
| 4,408,822 | A | * | 10/1983 | Nikitas | 439/583 |
| 4,990,106 | A | | 2/1991 | Szegda | |
| 5,195,906 | A | | 3/1993 | Szegda | |
| 5,352,134 | A | * | 10/1994 | Jacobsen et al. | 439/584 |
| 5,389,012 | A | | 2/1995 | Huang | |
| 5,393,244 | A | | 2/1995 | Szegda | |
| 5,795,188 | A | | 8/1998 | Harwath | |
| 5,877,452 | A | | 3/1999 | McConnell | |
| 5,888,094 | A | * | 3/1999 | Kubota et al. | 439/583 |
| 6,019,635 | A | * | 2/2000 | Nelson | 439/583 |
| 6,109,964 | A | * | 8/2000 | Kooiman | 439/583 |
| 6,293,824 | B1 | | 9/2001 | Guerin et al. | |
| 6,793,529 | B1 | * | 9/2004 | Buenz | 439/583 |
| 6,840,803 | B2 | | 1/2005 | Wlos et al. | |
| 7,077,700 | B2 | * | 7/2006 | Henningsen | 439/583 |
| 7,413,466 | B2 | | 8/2008 | Clark et al. | |
| 2001/0034159 | A1 | * | 10/2001 | Pitschi | 439/583 |

* cited by examiner

*Primary Examiner*—Gary F. Paumen
(74) *Attorney, Agent, or Firm*—Babcock IP, PLLC

(57) ABSTRACT

A coaxial connector for coaxial cable includes a body with a bore; a sidewall of the bore provided with a cable stop projecting radially inward at least to an inner diameter of the outer conductor; an annular contact groove proximate a cable end side of the cable stop; a contact seated within the contact groove; the contact configured to bias between the contact groove and an outer diameter of the outer conductor; an outer conductor section proximate a cable end side of the contact groove with an inward projecting outer conductor thread; an inner diameter of the outer conductor section greater than the outer diameter of the outer conductor; and a transition at the cable end side of the outer conductor section to a jacket section with an inward projecting jacket thread. An inner diameter of the jacket section is greater than an outer diameter of the jacket.

20 Claims, 12 Drawing Sheets

THREADED CRIMP COAXIAL CONNECTOR

BACKGROUND

1. Field of the Invention

This invention relates to coaxial cable connectors. More particularly, the invention relates to a connector for coaxial cable with a solid outer conductor. The connector is coupled to the coaxial cable via threading and a connector body radial crimp operation.

2. Description of Related Art

Coaxial cable connectors are used, for example, in communication systems requiring a high level of precision and reliability.

To create a secure mechanical and electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body, via a coupling nut. Representative of this technology is commonly owned U.S. Pat. No. 5,795,188 issued Aug. 18, 1998 to Harwath.

Interlocking machine threaded coupling surfaces between the metal body and the coupling nut of U.S. Pat. No. 5,795,188 and similarly configured prior coaxial connectors significantly increase manufacturing costs and installation time requirements. Another drawback is the requirement for connector disassembly, sliding the back body over the cable end and then performing a precision cable end flaring operation, which retains the cable within the connector body during threading. Further, care must be taken at the final threading procedure and/or additional connector element(s) added to avoid damaging the flared end portion of the outer conductor as it is clamped between the body and the coupling nut to form a secure electro-mechanical connection between the outer conductor and the connector.

Alternative coaxial connector solutions, utilizing gripping and/or support elements about which the connector body is then radially crimped and/or axially compressed to secure an electromechanical interconnection between the outer conductor of the coaxial cable and the connector, are also known in the art. Commonly owned U.S. Pat. No. 6,840,803 issued Jan. 11, 2005 to Wlos discloses a crimp connector for a specific helically corrugated solid outer conductor cable. Longitudinal retention is obtained by threading a mating section of the connector body bore onto the helical corrugations of the outer conductor. A crimp operation is performed to deform the corrugation interconnection, thus creating a secure electrical interconnection and preventing unthreading. This configuration is usable only with specific outer conductor helical corrugation configurations, and in environments with wide temperature variations it may be susceptible to interconnection quality degradation over time as the different thermal expansion coefficients between the connector body and solid outer conductor act upon the interconnection during repeated expansion and contraction.

Competition in the coaxial cable connector market has focused attention on improving electrical performance and minimization of overall costs, including materials costs, training requirements for installation personnel, reduction of dedicated installation tooling and/or the total number of required installation steps and/or operations.

Therefore, it is an object of the invention to provide a coaxial connector that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
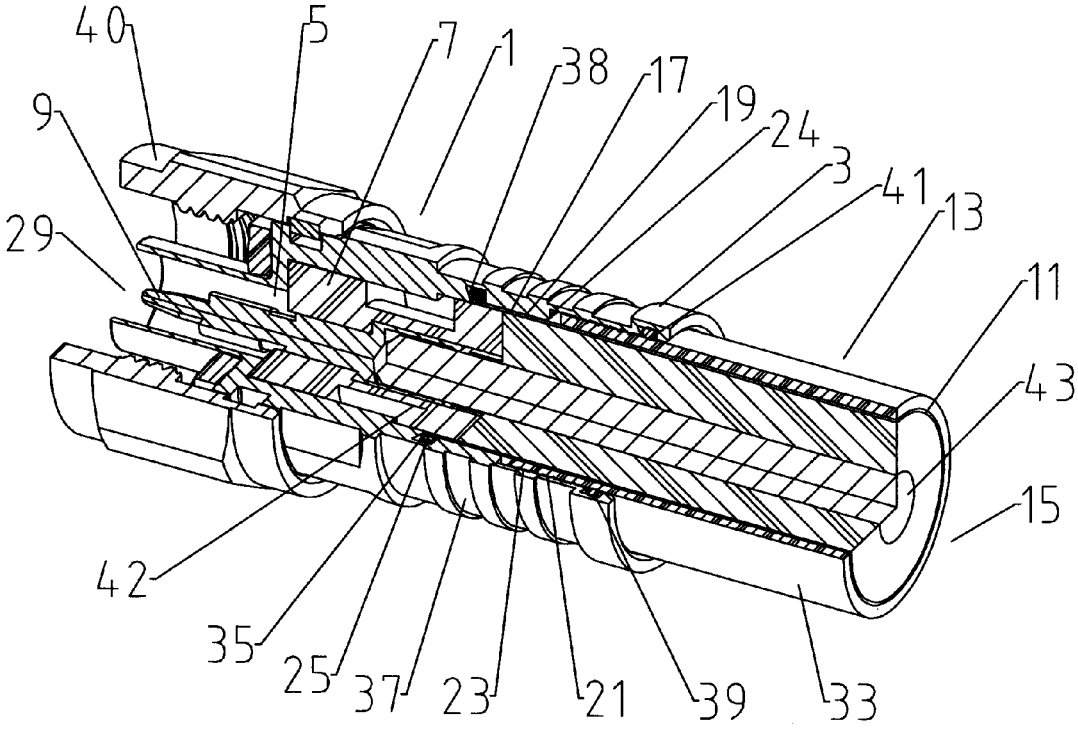
FIG. 1 is a schematic isometric partial cut away view of a first exemplary embodiment of a coaxial connector with a section of coaxial cable attached.
Figure 2:
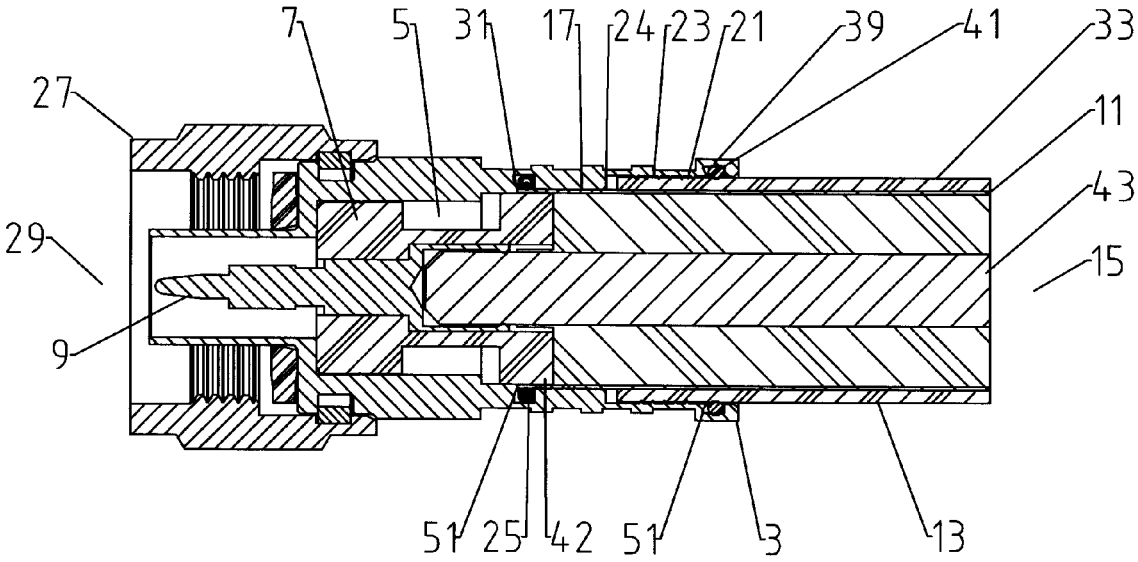
FIG. 2 is a schematic cross-section side view of the coaxial connector of FIG. 1, with a section of coaxial cable attached.

As shown in a first exemplary embodiment in FIGS. 1-9, a coaxial connector 1 according to the invention has a connector body 3 with a connector body bore 5. An insulator 7 seated within the connector body bore 5 supports an inner contact 9 coaxial with the connector body bore 5. The coaxial connector 1 mechanically retains the outer conductor 11 of a coaxial cable 13 inserted into the cable end 15 of the connector body bore 5 via an outer conductor thread 17 on the inner diameter of an outer conductor section 19 of the connector body bore 5 sidewall.

Further mechanical retention and/or alignment between the coaxial connector 1 and the coaxial cable 13 is provided by a jacket thread 21 located on the inner diameter of a jacket section 23 separated from the outer conductor section 19 by a transition 24 of the connector body bore 5 sidewall where the inner diameter of the connector body bore 5 is increased generally according to an expected jacket 33 thickness of the coaxial cable 13, enabling the jacket 33 to enter the jacket section 23 interfering only with the jacket thread 21 which is dimensioned to engage the jacket 33 at a desired thread depth.

Figure 6:
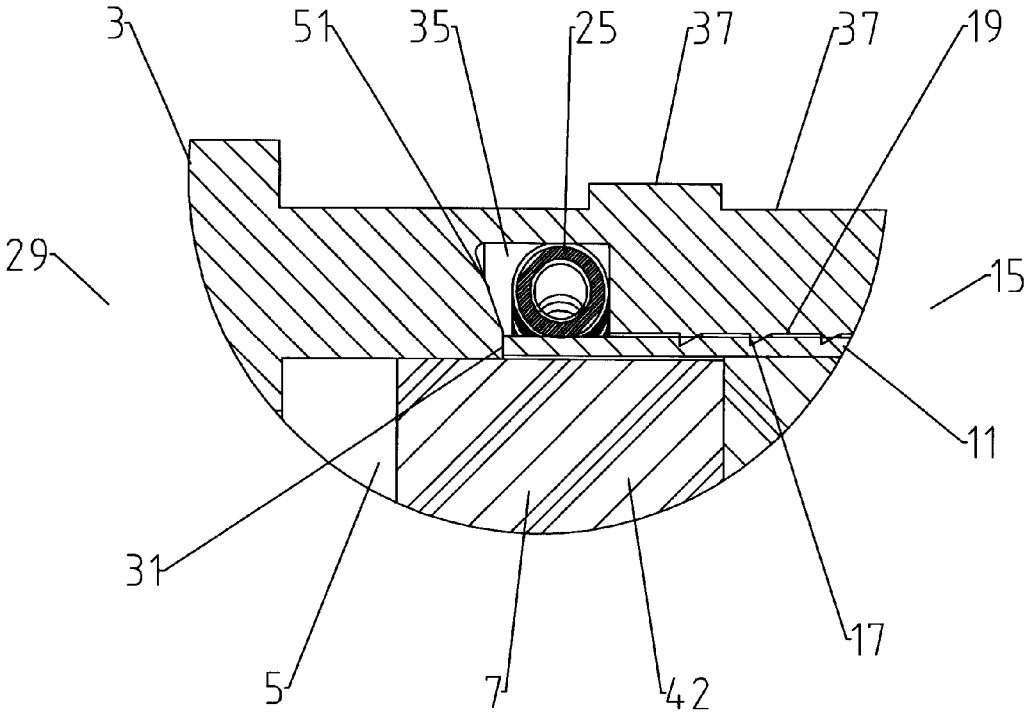
FIG. 6 is a close-up schematic cross-section side view of a contact groove portion of the connector of FIG. 2.
Figure 7:
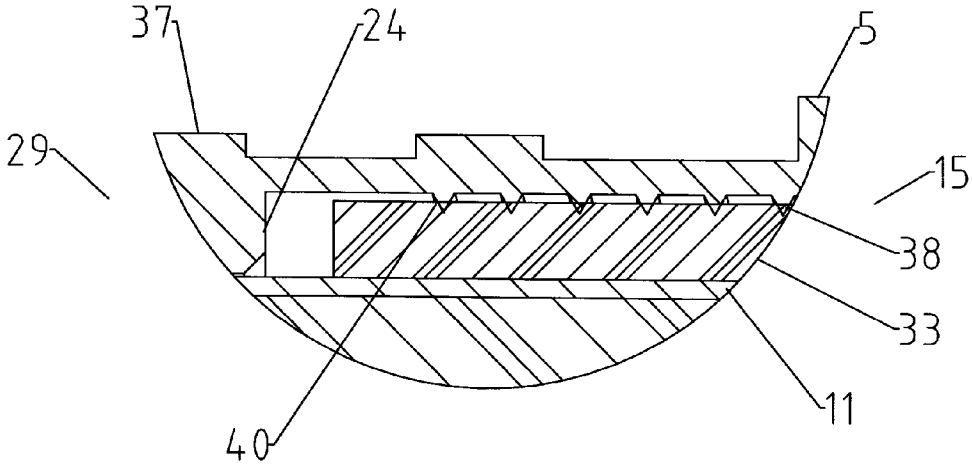
FIG. 7 is a close-up schematic cross-section side view of a jacket section portion of the connector of FIG. 2.

A contact 25, best shown in FIG. 6, seated within a contact groove 35 of the connector body bore 5 is biased between the contact groove 35 and the outer diameter of the outer conductor 11. The contact 25 makes circumferential contact with the outer conductor 11, electrically coupling the outer conductor 11 across the connector body 3 to a connector interface 27 at the connector end 29. The connector interface 23 may be any desired standard or proprietary interface.

After the coaxial cable 13 is threaded into the connector body bore 5 until the leading edge of the outer conductor 11 contacts the cable stop 31, a crimp tool is applied to an outer diameter crimp section 37 of the connector body 3 to apply a crimp action that deforms the connector body 3 around the coaxial cable 13, preventing unthreading of the coaxial cable 13 from the connector body 3.

One skilled in the art will appreciate that the cable end 15 and the connector end 29 are descriptors used herein to clarify longitudinal locations and contacting interrelationships between the various elements of the coaxial connector 1. In addition to the identified positions in relation to adjacent elements along the coaxial connector 1 longitudinal axis, each individual element of the connector and/or section of the connector body bore 5 has a cable end 15 side and a connector end 29 side, i.e. the sides of the respective element or section that are facing the respective cable end 15 and the connector end 29 of the coaxial connector 1.

Figure 3:
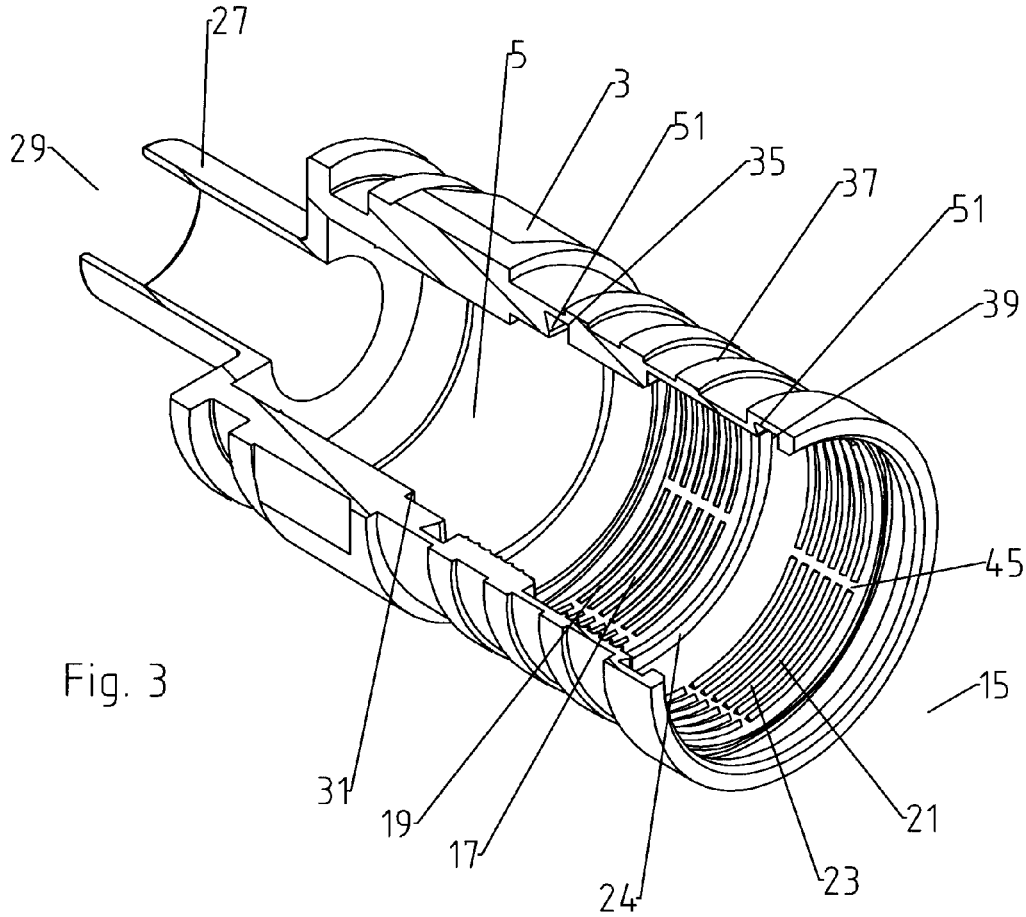
FIG. 3 is a schematic isometric partial cut away view of the connector body of FIG. 1.

As best shown in FIG. 3, the connector body 3 may be formed as a unitary monolithic element. The connector body bore 5 is dimensioned to receive the coaxial cable at the cable end 15 until a leading edge of the outer conductor contacts a cable stop 31 that projects radially inward at least to an inner diameter of the outer conductor 11. Before reaching the cable stop 31, the outer conductor 11 enters the outer conductor section 19 and engages the outer conductor thread 17 that threads into the solid outer conductor either via self-tapping thread or the like that gouges into the outer diameter of the outer conductor 11, or alternatively via a blunt thread that deforms the outer conductor radially inward as it is threaded on, forming a helical corrugation interlocked with the connector body 3. As the outer conductor 11 is threading into the outer conductor section, the jacket 33 of the coaxial cable 13 enters the jacket section 23 and engages the jacket thread 21.

A profile of the outer conductor thread 17 and/or jacket thread 21 may be dimensioned with a cable end face 38 and a connector end face 40. The cable end face 38 and the connector end face 40 may be provided with an equal angle to one another, or alternatively the connector end face 40 may be arranged with a slope, with respect to the outer conductor section 19, that is steeper than the cable end face 38 to improve the longitudinal retention of the thread upon the outer conductor 11 and/or jacket 33, for example as shown in FIGS. 4-7.

In further embodiments, the outer conductor thread 17 and/or jacket thread 21 may be formed with longitudinal groove(s) 45 for example as shown in FIG. 3. The longitudinal groove(s) 45 providing additional grip surfaces for outer conductor 11 material to flow into under the crimp force, further rotationally interlocking the outer conductor 11 and connector body 3 after the crimp operation has been applied.

One skilled in the art will appreciate that the combination of connector body 3 to outer conductor 11 and the connector body 3 to polymer material of the jacket 33 provides an extended interconnection between the coaxial cable 13 and the connector 1 with both secure longitudinal mechanical retention and close longitudinal alignment therebetween.

Before contacting the cable stop 31, the outer conductor 11 passes under the contact 25. The bias between the contact 25 and the outer conductor 11 provides an enhanced circumferential electrical contact with reduced susceptibility to electrical noise generation should the quality of the mechanical interlock provided by the outer conductor thread 17 and jacket thread 21 become compromised over time.

Figure 4:
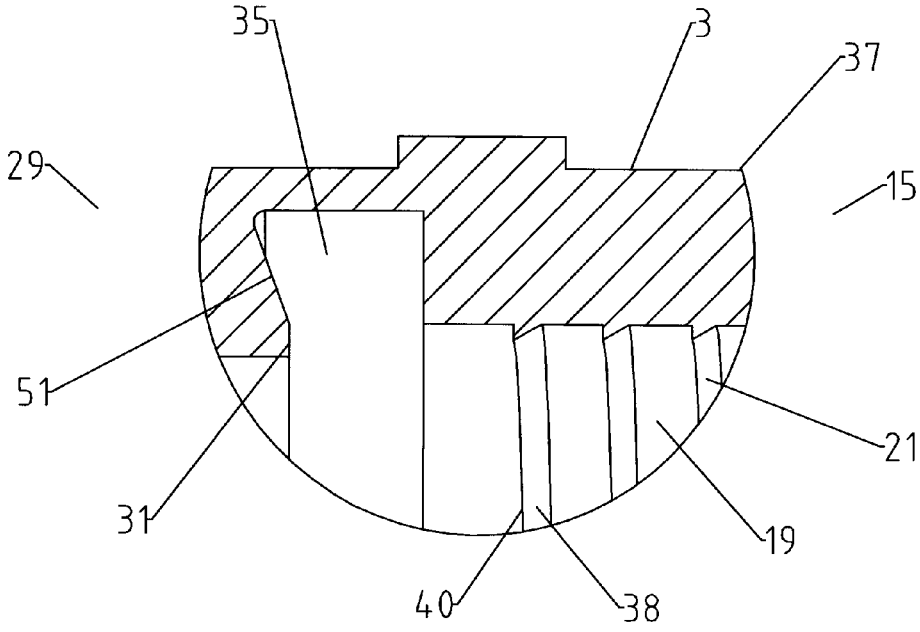
FIG. 4 is a close-up schematic cross-section side view of a contact groove portion of the connector body of FIG. 3.
Figure 5:
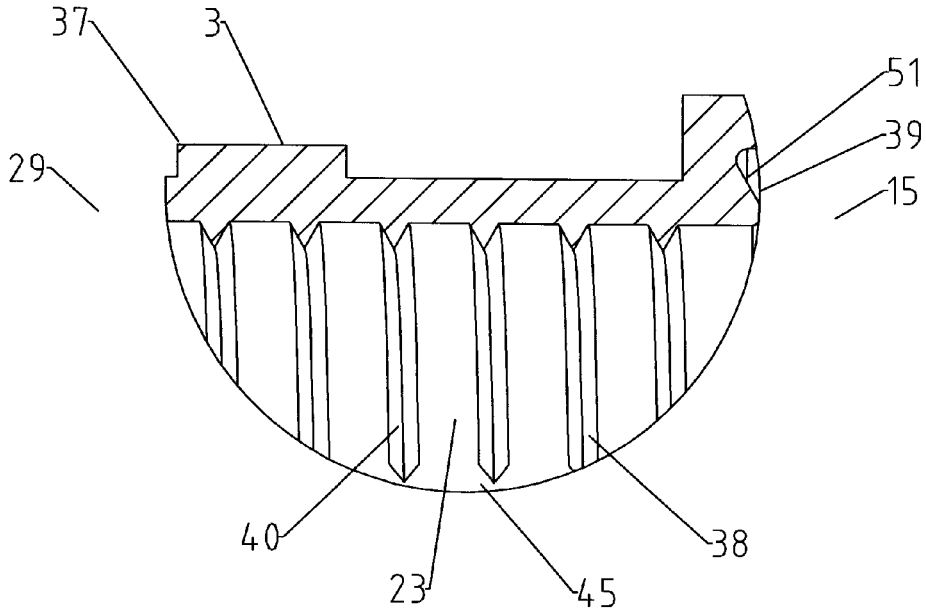
FIG. 5 is a close-up schematic cross-section view of a jacket section portion of the connector body of FIG. 3.

As best shown in FIGS. 4 and 6, the connector end 29 side of the contact groove 35 may be angled towards the connector end 29, creating a ramp surface 51 for the contact 25, enabling the contact 25 to be momentarily urged upward and outward as the outer conductor 11 contacts and/or passes beneath the contact 25 during insertion into the connector body bore 5, reducing the chance that the leading edge of the outer conductor 11 will bind against the contact 25 and/or reducing the insertion force needed during interconnection. A similar groove ramp surface 51 configuration (see FIG. 3) may also be applied to a seal groove 39 proximate the cable end 15 of the connector body bore 5. The seal groove 39 receiving a seal 41, such as an o-ring, to environmentally seal the connector body bore 5 against the jacket 33.

The area of the outer conductor 11 contacted by the contact 25 may be supported by an extended portion of the insulator 7 dimensioned to fit within the outer conductor 11 proximate the outer conductor 11 inner diameter. Thereby, should any deformation of the outer conductor 11 occur in response to the bias exerted by the contact 25, the outer conductor 11 is supported by the insulator 7.

Figure 8:
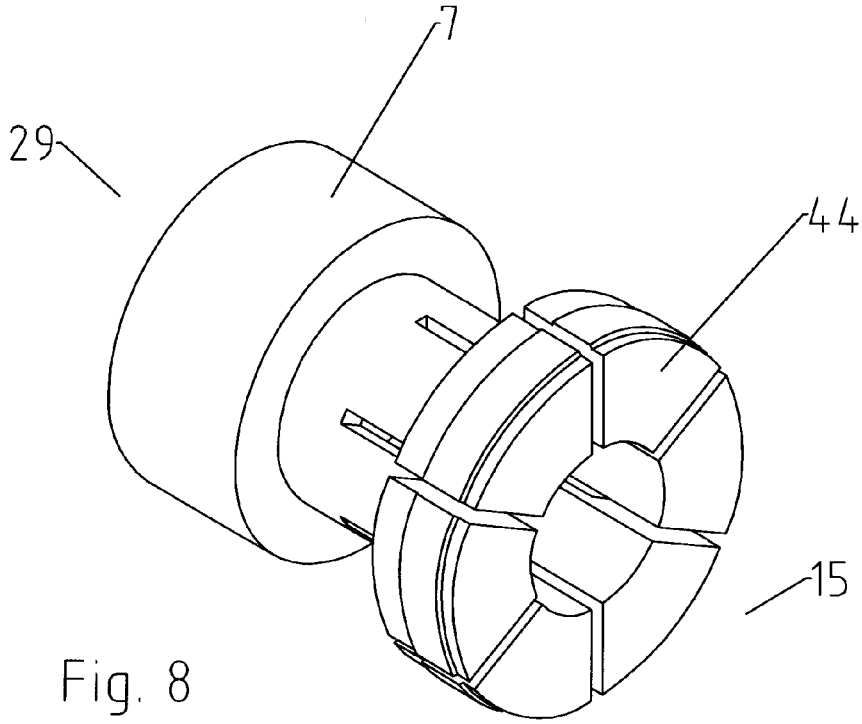
FIG. 8 is an schematic isometric cable end view of the insulator of the connector of FIG. 1.
Figure 9:
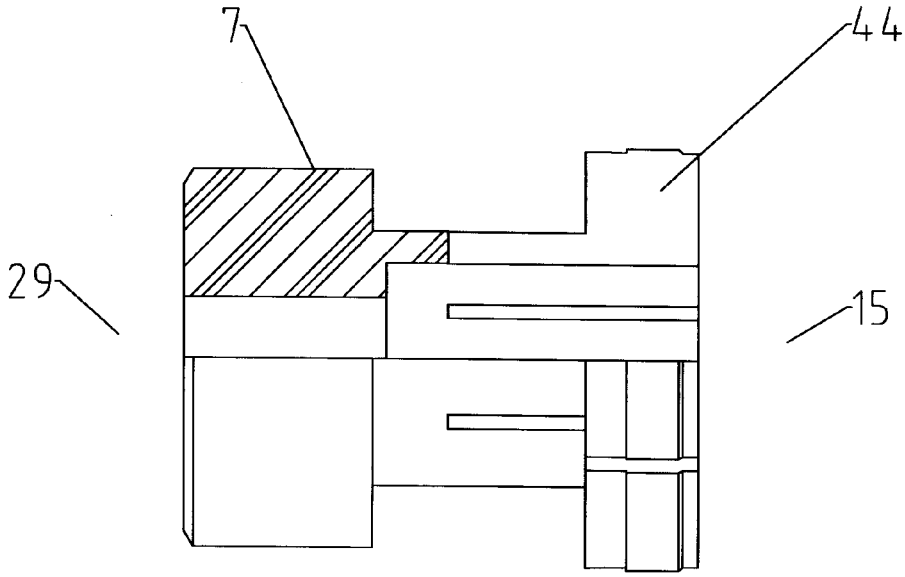
FIG. 9 is a schematic cross-section side view of the insulator of FIG. 8.

Alternatively, the insulator 7 may be formed with a plurality of deflectable insulator finger(s) 42 extending towards the cable end 15, for example as shown in FIGS. 8 and 9. Where the contact 25 is within the crimp section, the radial inward crimp action drives the contact 25 radially inward against the outer conductor 11 and the outer conductor 11 against the insulator fingers 42, driving the insulator fingers 42 inward to bias the inner contact 9 against the inner conductor 43, enhancing the electro-mechanical interconnection therebetween.

Figure 10:
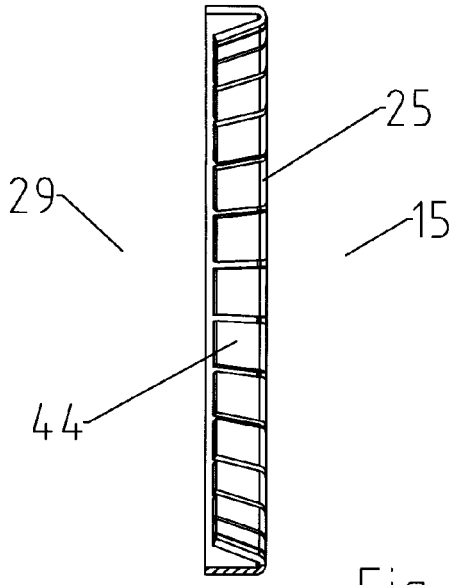
FIG. 10 is a schematic cross-section side view of a first alternative contact.
Figure 11:
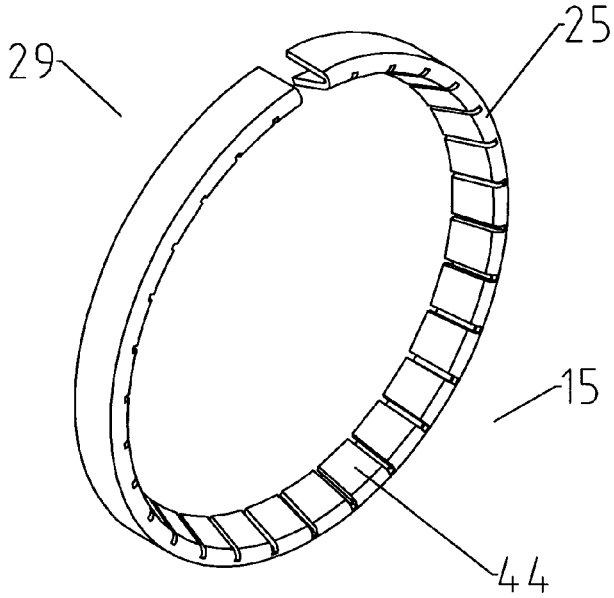
FIG. 11 is a schematic isometric cable end view of the contact of FIG. 10.
Figure 12:
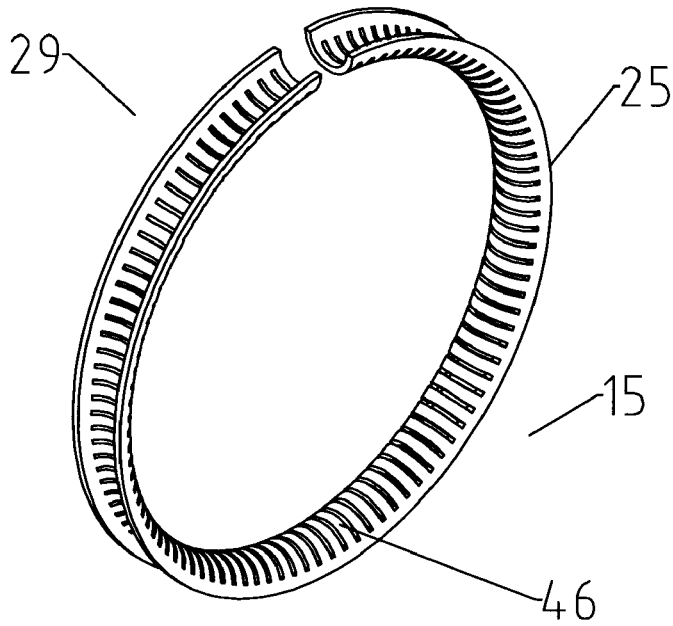
FIG. 12 is a schematic isometric cable end view of a second alternative contact.
Figure 13:
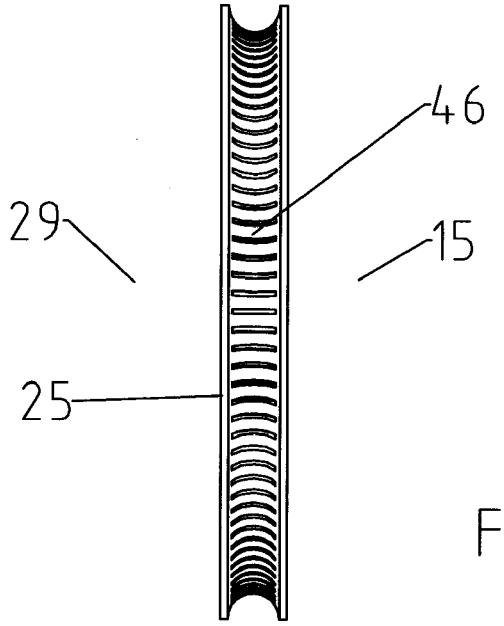
FIG. 13 is a schematic cross-section side view of the contact of FIG. 12.
Figure 14:
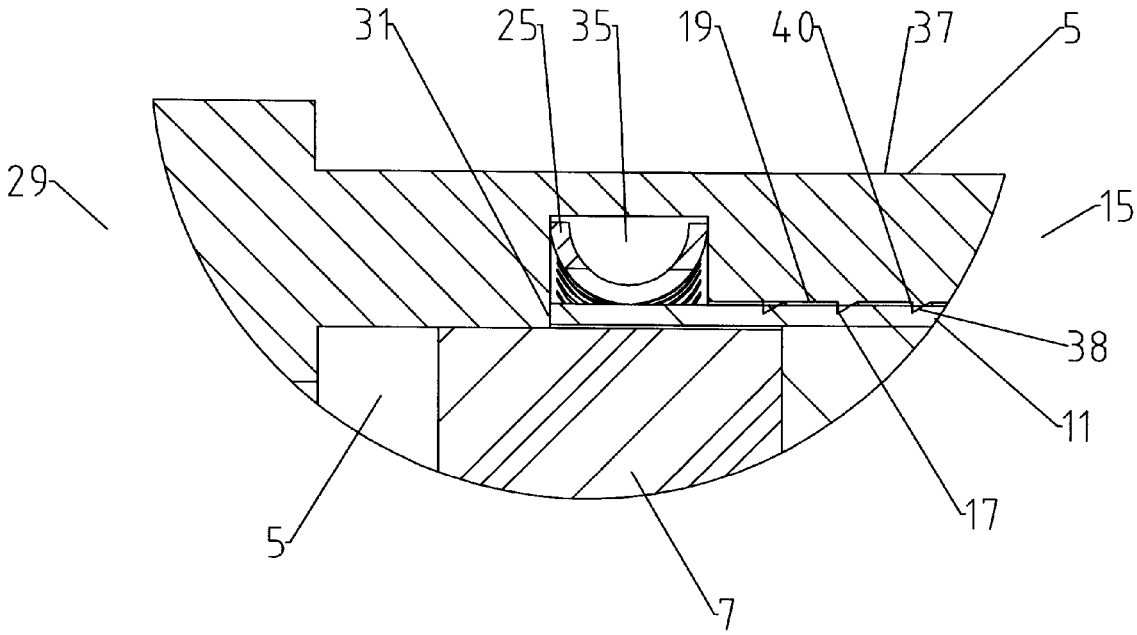
FIG. 14 is a close-up view of the contact groove area of a connector with the contact of FIG. 12, demonstrating contact between the contact, outer conductor and insulator.

The inner contact 25 may be applied as a helical coil spring, for example as shown in FIG. 6. Alternatively, the contact 25 may be provided as a ring with a V-Shaped (FIGS. 10 and 11) or U-shaped (FIGS. 12-14) cross section, for example, with a plurality of spring finger(s) 44 or band(s) 46, respectively, projecting inward.

Figure 15:
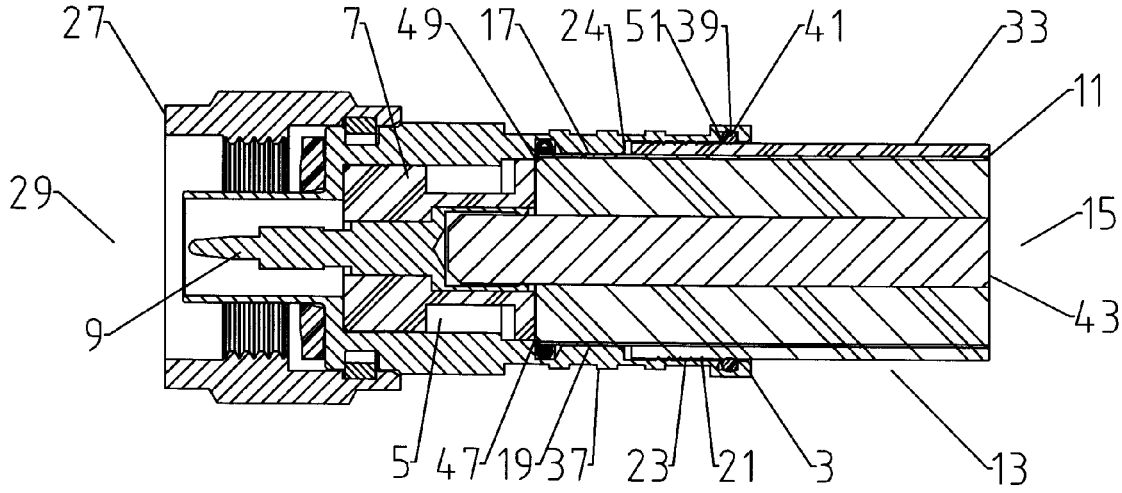
FIG. 15 is a schematic cross-section side view of a second exemplary embodiment of a coaxial connector with a section of coaxial cable attached.
Figure 16:
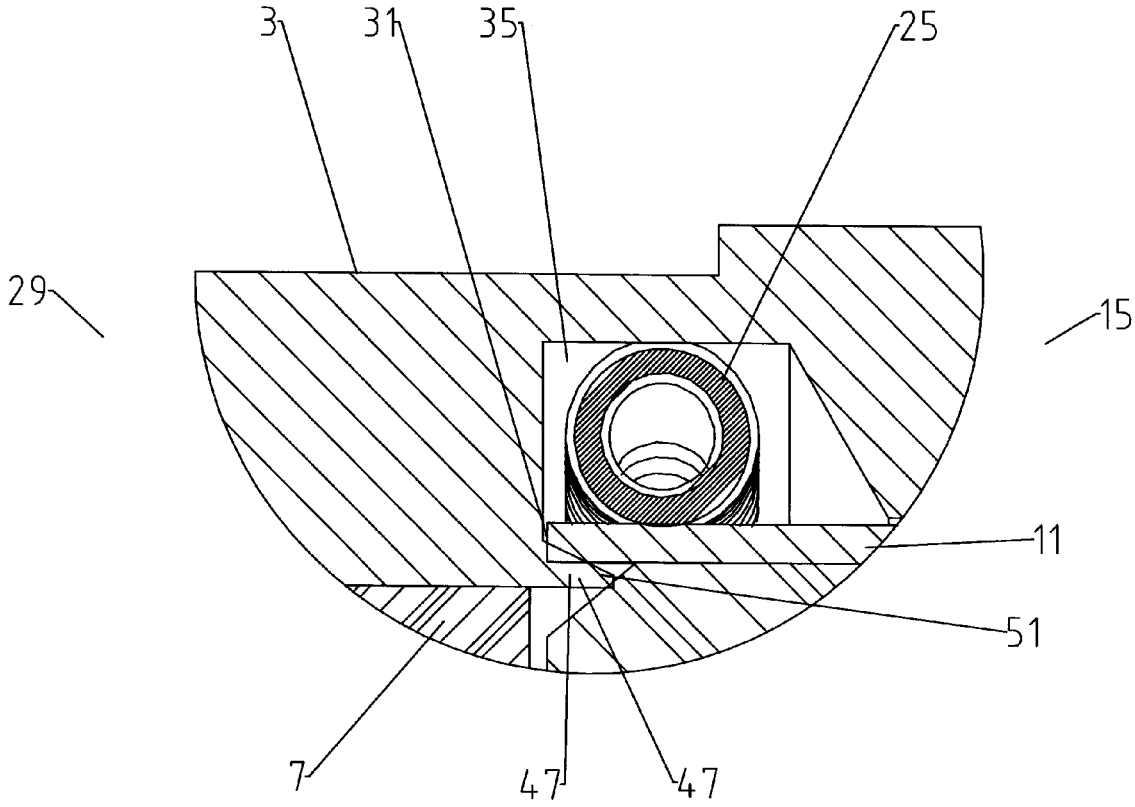
FIG. 16 is a schematic close-up view of the contact groove area of FIG. 15.

An alternative support for the leading edge of the outer conductor 11 may be incorporated into the connector body bore 3 as shown for example as shown in FIGS. 15-16. An outer conductor lip 47 projects towards the cable end 15 of the connector body bore 5 from an inner diameter of the cable stop 31, the outer conductor lip 47 forming an annular cable groove 49 open to the cable end 15 of the connector body bore 5. As best shown in FIG. 16, a lead edge of the outer conductor lip 47 may be formed with an angled ramp surface 51 operable as a guide for the leading edge of the outer conductor 11 during insertion into the connector body bore to seat the leading edge of the outer conductor 11 into the annular cable groove 49 with reduced chance of interference/binding upon the outer conductor lip 47.

Figure 17:
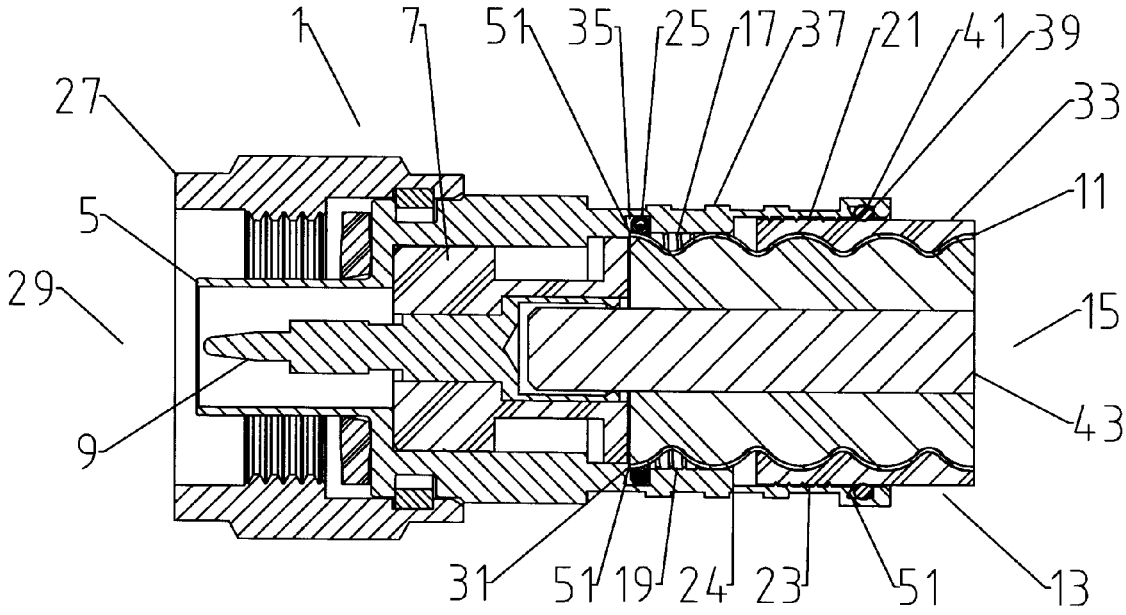
FIG. 17 is a schematic cross-section side view of a further exemplary embodiment of a coaxial connector with a section of corrugated solid outer conductor coaxial cable attached.

Although the various embodiments have been demonstrated with respect to a smooth walled solid outer conductor coaxial cable 13, one skilled in the art will appreciate that the connector 1 may also be used with corrugated solid outer conductor coaxial cable 13. As shown for example in FIG. 17, the corrugation peaks of a corrugated solid outer conductor 11 are similarly engaged by the outer conductor thread 17 and the jacket thread 21 engages the jacket 33 to provide longitudinal retention.

A method for installing the coaxial connector 1 includes the steps of preparing the end of the coaxial cable 13 according to the connector 1 configuration, and stripping back a desired portion of the jacket 33. The end of the coaxial cable 13 is then inserted into the connector body bore 5 and the outer conductor 11 threaded upon the outer conductor thread 17 until the jacket 33 contacts the jacket thread 21, then threading the outer conductor thread 17 onto the outer conductor 11 and the jacket thread 21 onto the jacket 33 until the leading edge of the outer conductor 11 passes under the contact 25 and abuts the cable stop 31. Finally, a crimp force is applied to the crimp section 37 to deform the connector body 3 radially inward around the coaxial cable 13, thus inhibiting unthreading of the connector body 3 from the coaxial cable 13. If the coaxial connector 1 is equipped with the insulator finger 42 configuration, as the crimp force is applied, the inward movement of the connector body 3 drives the outer conductor 11 inward against the insulator fingers 42 and the insulator fingers 42 inward against an interconnection between the inner contact 9 and the inner conductor 43.

One skilled in the art will appreciate that the prior manual cable end flaring operations and any required disassembly/reassembly of the various connector elements around the coaxial cable end during installation have been eliminated.

| Table of Parts | |
|---|---|
| 1 | coaxial connector |
| 3 | connector body |
| 5 | connector body bore |
| 7 | insulator |
| 9 | inner contact |
| 11 | outer conductor |
| 13 | coaxial cable |
| 15 | cable end |
| 17 | outer conductor thread |
| 19 | outer conductor section |
| 21 | jacket thread |
| 23 | jacket section |
| 24 | transition |
| 25 | contact |
| 27 | connector interface |
| 29 | connector end |
| 31 | cable stop |
| 33 | jacket |
| 35 | contact groove |
| 37 | crimp section |
| 38 | cable end face |
| 39 | seal groove |
| 40 | connector end face |
| 41 | seal |
| 42 | insulator finger |
| 43 | inner conductor |
| 44 | spring finger |
| 45 | longitudinal groove |
| 46 | band |
| 47 | outer conductor lip |
| 49 | cable groove |
| 51 | ramp surface. |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A coaxial connector for coaxial cable with an inner conductor and a solid outer conductor; a polymer jacket upon the outer conductor, the coaxial connector comprising:

a body with a bore; a sidewall of the bore comprising:

a cable stop projecting radially inward at least to an inner diameter of the outer conductor;

an annular contact groove proximate a cable end side of the cable stop;

a contact seated within the contact groove; the contact configured to bias between the contact groove and an outer diameter of the outer conductor;

an outer conductor section proximate a cable end side of the contact groove with an inward projecting outer conductor thread; an inner diameter of the outer conductor section greater than the outer diameter of the outer conductor;

a transition at the cable end side of the outer conductor section to a jacket section with an inward projecting jacket thread; an inner diameter of the jacket section greater than an outer diameter of the jacket.

2. The connector of claim 1, further including an outer conductor lip projecting towards the cable end of the bore from an inner diameter of the cable stop; the outer conductor lip forming an annular cable groove open to the cable end of the bore.

3. The connector of claim 2, further including a ramp surface on the outer conductor lip.

4. The connector of claim 1, further including an insulator supporting an inner contact configured to couple with the inner conductor.

5. The connector of claim 4, wherein the insulator extends towards the cable end of the bore, under the contact groove.

6. The connector of claim 5, wherein a cable end of the insulator is formed as a plurality of fingers.

7. The connector of claim 1, wherein the outer conductor thread is a self tapping thread.

8. The connector of claim 7, wherein the outer conductor thread has a cable end face and a connector end face; the connector end face arranged with a slope, with respect to the outer conductor section, that is steeper than the cable end face.

9. The connector of claim 1, wherein the outer conductor thread is formed with a plurality of longitudinal grooves breaking the outer conductor thread continuity.

10. The connector of claim 1, wherein the contact is a circular helical coil spring.

11. The connector of claim 1, wherein the contact is ring with a U-shaped cross section.

12. The connector of claim 1, wherein the contact is a ring with a plurality of spring fingers extending inward.

13. The connector of claim 1, wherein a connector end side of the contact groove has a ramp surface angled towards a connector end of the body.

14. The connector of claim 1, further including an annular gasket groove proximate the cable end of the bore.

15. The connector of claim 14, wherein a connector end side of the gasket groove has a ramp surface angled towards a connector end of the body.

16. The connector of claim 1, wherein a crimp section on an outer diameter of the body corresponds longitudinally to at least a portion of each of the outer conductor section and the jacket section.

17. The connector of claim 1, wherein a crimp section on an outer diameter of the body corresponds longitudinally with the contact groove.

18. A method for installing a coaxial connector upon a coaxial cable with an inner conductor and a solid outer conductor; a polymer jacket upon the outer conductor, comprising the steps of:

removing a portion of the jacket from an end of the coaxial cable;

inserting the end of the coaxial cable into a bore of a body until a leading edge of the outer conductor contacts an inward projecting outer conductor thread of an outer conductor section of the bore;

threading the outer conductor thread onto the outer conductor until the jacket contacts an inward projecting jacket thread of a jacket section of the bore;

threading the outer conductor thread onto the outer conductor and the jacket thread into the jacket until the leading edge of the outer conductor passes under a contact seated in a contact groove and abuts a cable stop projecting radially inward.

19. The method of claim 18, wherein the threading of the outer conductor thread upon the outer conductor deforms the outer conductor.

20. The method of claim 18, wherein the threading of the outer conductor thread upon the outer conductor cuts into the outer diameter of the outer conductor.

* * * * *